US005415738A

United States Patent [19]

Mehta et al.

[11] Patent Number: 5,415,738

[45] Date of Patent: May 16, 1995

[54] WET-LAID NON-WOVEN FABRIC AND METHOD FOR MAKING SAME

[75] Inventors: Haresh R. Mehta; Tejendra M. Singh; Joseph E. Meyer, all of Corvallis, Oreg.

[73] Assignee: Evanite Fiber Corporation, Corvallis, Oreg.

[21] Appl. No.: 35,984

[22] Filed: Mar. 22, 1993

[51] Int. Cl.[6] ..... D21H 13/24

[52] U.S. Cl. ..... 162/146; 162/157.3; 162/206; 162/207

[58] Field of Search ..... 162/146, 157.2, 157.3, 162/206, 207

[56] References Cited

U.S. PATENT DOCUMENTS

| | | | |
|---|---|---|---|
| 1,104,759 | 7/1914 | Sheahan . | |
| 1,606,310 | 11/1926 | McCorkindale . | |
| 2,477,000 | 7/1949 | Osborne | 162/146 |
| 2,899,264 | 8/1959 | Griffiths et al. . | |
| 2,999,788 | 9/1961 | Morgan | 162/146 |
| 3,272,656 | 9/1966 | Corbin et al. | 162/146 |
| 3,378,936 | 4/1968 | Buss . | |
| 3,674,621 | 2/1970 | Miyamoto et al. | 162/146 |
| 3,756,908 | 9/1973 | Gross . | |
| 3,816,941 | 6/1974 | Holik et al. . | |
| 3,956,832 | 5/1976 | Justus . | |
| 4,274,915 | 6/1981 | Munari . | |
| 4,306,929 | 12/1981 | Menikheim et al. . | |
| 4,512,849 | 4/1985 | Brandon et al. . | |
| 4,519,873 | 5/1985 | Amano et al. . | |
| 4,622,758 | 11/1986 | Lehtinen et al. . | |
| 4,668,562 | 5/1987 | Street . | |
| 4,734,321 | 3/1988 | Radvan et al. | 162/146 |
| 4,738,035 | 4/1988 | Grebe et al. . | |
| 4,769,266 | 9/1988 | Lerner et al. . | |
| 4,822,452 | 4/1989 | Tse et al. . | |
| 4,904,520 | 2/1990 | Dumas | 162/146 |
| 4,904,523 | 2/1990 | Kampf et al. . | |
| 4,906,521 | 3/1990 | Turunen et al. . | |
| 4,973,382 | 11/1990 | Kinn et al. . | |
| 4,992,141 | 2/1991 | Sullivan . | |
| 5,079,074 | 1/1992 | Steagall et al. . | |
| 5,133,835 | 7/1992 | Goettmann et al. | 162/146 |
| 5,238,534 | 8/1993 | Manning et al. | 162/157.2 |

FOREIGN PATENT DOCUMENTS

| | | | |
|---|---|---|---|
| 465203 | 1/1992 | European Pat. Off. | 162/157.3 |

*Primary Examiner*—Peter Chin

*Attorney, Agent, or Firm*—Klarquist, Sparkman, Campbell, Leigh & Whinston

[57] ABSTRACT

Non-woven fabrics and methods and apparatus for their manufacture are disclosed. The fabrics have excellent mechanical strength and hand, and have a substantial uniformity of constituent fibers even at low basis weights. The fabric comprises chopped fibers of a synthetic polymeric thermoplastic material, which serve as binder fibers, and chopped fibers of a synthetic polymeric material which need not be a thermoplastic, which serve as bonded fibers. No extraneous binder materials need be present in the fabric. During manufacture, the binder fibers are uniformly dispersed in an aqueous liquid with the bonded fibers. The fibers are wet laid to form a web which is subsequently dried. During drying, the web is physically supported to prevent fracture. Also, during drying, the web is heated sufficiently to cause the binder fibers to bond to the bonded fibers, thereby forming the finished fabric.

17 Claims, 2 Drawing Sheets

WET-LAID NON-WOVEN FABRIC AND METHOD FOR MAKING SAME

FIELD OF THE INVENTION

This invention relates to non-woven webs and fabrics made from synthetic fibers, and to processes and machinery for making the same.

BACKGROUND OF THE INVENTION

Certain methods for making fabrics by bonding together fibers of two types of thermoplastic material are known. However, these conventional methods, and products made thereby, have particular disadvantages. Furthermore, the art of making non-woven fabrics is demanding; a method or product that is ideally suited for one application can be completely unsuitable for another application, even though, for example, the products share some (perhaps many, but not all) characteristics.

U.S. Pat. No. 4,904,523, discloses non-woven fabrics having multiple layers each comprising fibers that are dry laid. In a representative embodiment, a first layer comprises thermoplastic matrix fibers and a second layer comprises expensive binder fibers. The second layer is superposed on the first layer and the resulting composite is heated to a temperature that is lower than the melting or softening point of the matrix fibers but higher than the softening point of the binder fibers. Thus, the binder fibers comprising the second layer become adhered to the matrix fibers comprising the first layer. Unfortunately, certain areas of the fabric are subject to delamination because uniform bonding between the layers is difficult to achieve.

Other conventional methods for making such fabrics include forming non-woven webs of continuous thermoplastic fibers, such as disclosed in U.S. Pat. No. 4,769,266. The continuous fibers are bonded together by the application of heat to soften the fibers sufficiently to render them cohesive. In such thermal binding techniques, the web can be subjected to both heat and compression to increase interfiber contact. A disadvantage of such methods is that, when the fibers are bonded at substantially all points of interfiber contact, the resulting fabrics tend to be stiff. Also, achieving a uniform distribution in a fabric of continuous fibers, which is required for certain applications, has proven elusive. The latter is unfortunate because the characteristically uneven distribution of fibers in such fabrics reduces the mechanical strength of the fabric.

Finally, U.S. Pat. No. 3,756,908 discloses a non-woven flexible sheet consisting essentially of commingled fibrids of a non-fusible aromatic polyamide and short aromatic polyamide fibers. Fibrids are defined in this reference as small non-rigid film-like particles having two of their three spatial dimensions on the order of microns. The fibers and fibrids are disposed in a slurry and wet-laid on a paper-forming wire to form a web. The web is dried by passage over the surfaces of steam-heated cylindrical dryer cans at a temperature not exceeding 185° C. Interfiber bonding is facilitated by subjecting the sheet to compaction by a heated calender. Unfortunately, this process requires expensive calendering equipment to achieve a satisfactory web strength for intended applications.

In view of the shortcomings of the prior art, there is a need for non-woven fabrics having a substantially uniform distribution of chopped fibers of synthetic polymeric materials, wherein the fibers are bonded to each other in the fabric without the use of extraneous binder materials.

There is also a need for such fabrics that exhibit, even at low basis weights (less than 1.0 oz/yd$^2$), superior strength as measured by, for example, tear strength and burst strength.

There is also a need for such fabrics having excellent "hand" characteristics.

There is also a need for methods and equipment adapted for manufacturing the foregoing needed non-woven fabrics.

SUMMARY OF THE INVENTION

The foregoing needs are met by the present invention which provides non-woven fabrics or webs having excellent mechanical strength, good drapeability ("hand") and substantially uniform distributions of fibers, even at low basis weights; and methods and equipment for manufacturing such fabrics. In general, the fabric comprises chopped fibers of a first synthetic polymeric material having thermoplastic properties and chopped fibers of a second synthetic polymeric material. The fibers of the first material have a melt temperature that is lower than the melt temperature of the fibers of the second material so as to enable the fibers of the first material to serve in the finished fabric as "binder fibers" for the fibers of the second material ("bonded fibers") at points of inter-fiber contact. Thus, no extraneous binder materials are required in the fabric. In addition, the fibers of both types of materials are wet-laid to form the fabric, thereby ensuring a uniform distribution of both types of fibers in the fabric, even at low basis weights (less than 1.0 oz/yd$^2$). Also, binding of binder fibers to bonded fibers is uniform throughout the length, width, and thickness of the fabric, thereby providing not only excellent strength characteristics, even at low basis weights, but also excellent drapeability ("hand").

In a method according to the present invention, a uniform aqueous suspension of binder fibers and bonded fibers is prepared, then wet-laid to produce uniform distribution of both types of fibers. The wet web is then physically supported so as to prevent fracture of the web while being passed through a drying zone. For example, the wet web is sandwiched between twin dryer felts and passed over a convoluted array of steam-heated cylindrical dryer cans. In the drying zone, the binder fibers are heated to a temperature higher than their melt temperature so as to cause the binder fibers to adhere both to themselves and to the bonded fibers at points of inter-fiber contact. Use of twin dryer felts maintains the structural integrity of the fragile wet web until drying and bonding is complete.

DETAILED DESCRIPTION

Figure 1:
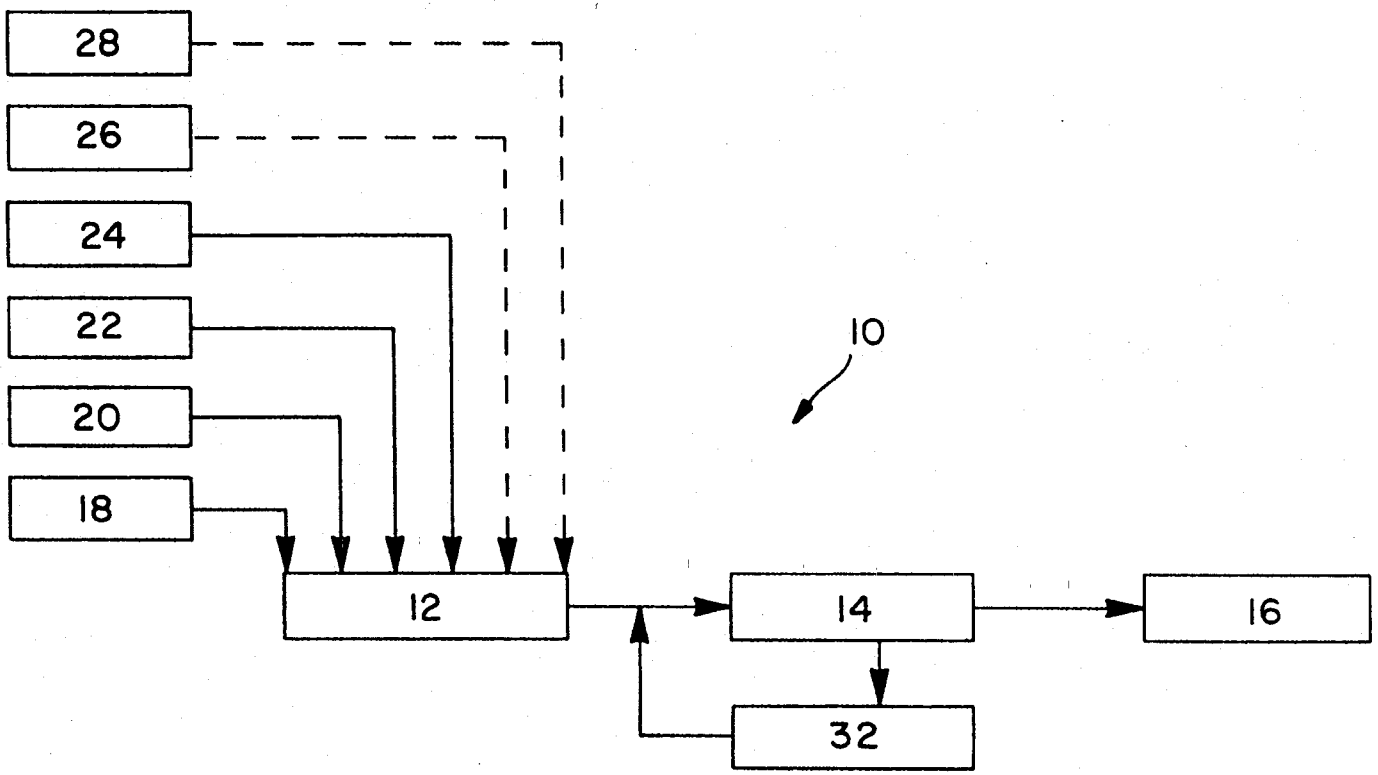
FIG. 1 is a block diagram of a process according to the present invention.

According to one aspect of the present invention, a single-layered, non-woven fabric is provided that comprises two types of chopped synthetic polymeric fibers bonded together at points of interfiber contact. At least one type of fiber is a thermoplastic fiber and serves as a "binder fiber." When forming the fabric, both types of fibers are mixed together in a uniform aqueous suspension of the fibers and wet-laid, such as on a rotoformer, to produce a fabric in which the distribution of fibers is substantially uniform. Such a uniform distribution of fibers in the fabric, now available for the first time, allows the mechanical strength of the fabric to be substantially increased, even at low basis weights, without unduly reducing the drapeability of the fabric.

Definitions

As used herein, "synthetic" denotes a material not normally formed in any substantial amount in nature and is thus a man-made material.

"Polymeric" denotes a material comprised substantially of polymer molecules. As is known in the art, polymer molecules are large molecules formed from plural molecular entities, termed monomers, that are linked together end-to-end in chains which can be linear or branched. Virtually all materials conventionally known as "plastic" are polymeric materials.

"Thermoplastic" materials are materials that can undergo a reversible softening, and ultimately liquefaction, upon heating but which do not experience a change in molecular structure (such as decomposition) when so heated. Thermoplastic materials can be repeatedly softened by heating and "hardened" by cooling. Generally, such materials comprise molecules that are not cross-linked. Also, such materials are generally rigid at room temperature (70° F.) and exhibit softening at higher temperatures, typically in a range of about 150° F. to about 600° F. or higher. A thermoplastic polymeric material typically does not have a specific temperature at which it suddenly begins to transform into a liquid. Rather, such a material tends to exhibit a broad "melting" temperature range over which, as the temperature is increased, the material becomes softer and more fluid. Thus, thermoplastics are distinguished from "thermoset" materials which consist of molecules that are so chemically cross-linked such that they cannot be made to "melt" by heating (i.e., the molecules cannot be made to move freely relative to each other when heated).

"Melt temperature" as used herein is a temperature at which fibers of a synthetic polymeric material are sufficiently softened to exhibit an adhesive property when contacted with other fibers of the same or a different synthetic polymeric material.

"Chopped fibers" are fibers that are not longitudinally continuous. Chopped fibers each have a definite length, typically a short length. Chopped fibers used to make fabrics according to the present invention preferably, but not necessarily, have substantially the same length.

"Bonded fibers" are fibers that, when formed into a fabric according to the present invention, are held together at points of inter-fiber contact by "binder" fibers. Bonded fibers are made from a synthetic polymeric material which could be, but need not be, a thermoplastic material. The polymeric material from which bonded fibers are made typically has a high melt temperature particularly when compared to binder fibers.

"Binder fibers" are fibers of a synthetic thermoplastic polymeric material. When binder fibers are subjected to a temperature at their melt temperature, the binder fibers soften sufficiently to be able to bind to themselves and to the bonded fibers at points of inter-fiber contact in a fabric according to the present invention.

"Denier" is defined as a unit expressing the mass of a fiber divided by its length. One denier is equal to 1 gram per 9,000 meters of fiber.

A "non-woven" fabric is a fabric in which the fibers are essentially randomly associated with each other. Thus, non-woven fabrics are contrasted with woven fabrics in which the fibers are first organized into threads or the like that are subsequently woven or otherwise associated with each other in an organized way to produce the fabric.

"Burst strength" is a measure of the ability of a fabric to withstand pressure without rupture; it is the pressure required to burst a fabric of a given basis weight.

"Tensile strength" as known in the art is the maximum stress a fabric subjected to a stretching load can withstand without tearing.

"Machine direction" is the direction in which a non-woven fabric or web is moved when being formed in a web-forming machine.

"Basis weight" is the weight of the fabric in ounces per square yard of the fabric.

Raw Materials

Fabrics according to the present invention contain substantially no binders (i.e. substances other than fibers employed for adhering fibers of the fabric together). Therefore, in order to achieve sufficient interfiber adhesion to form a fabric, a first group of fibers (termed bonded fibers) comprising the fabric is made from a synthetic polymeric material that can be, but need not be, a thermoplastic. Alternatively, the bonded fibers can be made from a synthetic thermoset polymeric material.

A second group of fibers (termed binder fibers) comprising the fabric is made from a synthetic thermoplastic material. Thus, the binder fibers, by virtue of their thermoplastic characteristic, are used to bind together other binder fibers as well as bonded fibers to form a fabric according to the present invention.

Whenever the binder and bonded fibers are both thermoplastic, the binder fibers have a lower melt temperature than the bonded fibers. Thus, when heated to effect inter-fiber bonding, the binder fibers soften sufficiently to adhere to themselves and to the bonded fibers. The thermoplastic bonded fibers, in contrast, would require heating to a significantly higher temperature before exhibiting a similar degree of softening. It is preferable that the binder fibers have a melt temperature at least about 25°–50° F. lower than the bonded fibers.

The bonded and binder fibers can be made of the same general type of polymer or made from different synthetic thermoplastic polymeric materials (so long as the melt temperature parameters discussed above are applicable).

Candidate thermoplastic polymeric materials include, but are not limited to: polyethylene, polypropylene, and any of various types of thermoplastic polyesters. In fact, virtually any type of synthetic thermoplastic polymeric material would work simply because of the thermoplastic nature of such materials.

As stated above, the material of the bonded fibers can also be a synthetic thermoset polymeric material. The bonded fibers can also be a cellulosic material or a synthetic vitreous fiber material.

The material of the binder fibers is preferably a thermoplastic polyester having a melt temperature of about 180° F. to about 400° F., with the preferred melt temperature being 390° F. Correspondingly, the bonded fibers can be a polyester having a melt temperature greater than about 400° F., with a preferred melt temperature ranging from about 475° F. to about 485° F. In such an instance, the binder fibers preferably have a melt temperature at least about 50° F. lower than the melt temperature of the bonded fibers.

The bonded and binder fibers have a denier within a range of about 0.25 to about 3.0. The denier of both 3.0 types of fibers can be the same or different within this range.

In accordance with the foregoing range of possible denier values, the bonded and binder fibers are chopped to a length generally less than or equal to about 1 inch. Although both types of fibers preferably have the same length within this range, they can also have different lengths. The preferred length of the fibers of the present invention is about 0.25 to about 0.75 inch. Forming a web from chopped fibers within the stated length range, as opposed to forming the web from, for example, continuous fibers, enables the requisite uniformity of fiber distribution in the resulting fabric to be attained. The uniform fiber distribution is particularly advantageous when producing fabrics, according to the present invention, having a low basis weight.

When the fibers are added to an aqueous liquid (discussed in detail below), attaining a uniform distribution of the fibers can be aided by adding chemicals, such as surfactants and viscosity modifiers, to the aqueous liquid. These chemicals can be added to the aqueous liquid before, after, or simultaneously with the fibers.

Since synthetic hydrophobic fibers, such as polyester fibers, can be difficult to disperse in water and other aqueous liquids, use of surfactants to facilitate dispersion may be indicated. Preferable surfactants are selected from the general group consisting of amine surfactants. The appropriate surfactant generally depends upon the types of materials comprising the fibers. Selection of a suitable surfactant is readily performed by simply trying several surfactants and selecting the one that achieves the desired fiber "wetting" in the shortest time. Such procedures are well known by skilled artisans who are routinely faced with selecting a surfactant for a particular task. In fact, surfactant manufacturers often provide test kits for just such a purpose.

If used, the surfactant must be compatible with the fibers in the aqueous liquid in order to satisfactorily reduce the surface tension of the aqueous liquid. Reducing the surface tension of the aqueous liquid allows each individual fiber to be wetted by the aqueous liquid, which greatly facilitates separation of fiber bundles. Thorough wetting of fibers also facilitates penetration of tiny air bubbles between fibers during agitation of the suspension of fibers in the aqueous liquid, thereby further speeding up fiber dispersion in the liquid. Preferably, a surfactant is selected which does not cause formation of excess foam at the required surfactant concentration in the aqueous liquid.

In general, the usual concentration of surfactant is within a range of about 0.5 to 5.0%. It is preferred to not use more surfactant than is necessary to achieve rapid wetting and uniform suspension of the fibers so as to avoid excessive foaming and related problems.

If necessary, a small amount of conventional defoamer can be added to the aqueous suspension to reduce the amount of foam.

Appropriate viscosity modifiers are selected from a general group consisting of amides. When a viscosity modifier is added to the aqueous liquid, it is usually at a concentration of about 0.5 to about 5.0%.

pH modification of the aqueous liquid is usually not required, particularly when the water is obtained from a source having a pH within a range of about 2.5 to 9.5. If pH modification is required to bring the aqueous suspension to within this range, the usual inorganic reagents can be used. For example, HCl can be used to lower pH and NaOH can be used to increase pH.

In a process according to the present invention, the fibers are added to the aqueous liquid to form a suspension (this step is discussed in greater detail below). Preferably, the suspension contains about 0.1% (w/w) to about 2% (w/w) fibers relative to the liquid (wherein "% (w/w)" denotes a gravimetric percent). The preferred fiber concentration is about 0.5% (w/w). In general, the stated concentration range represents a practical range in which the fibers can be uniformly dispersed in the aqueous liquid. In a process according to the present invention, fiber dispersion problems can arise when the fiber concentration in the suspension exceeds about 2% (w/w).

The temperature of the water used to prepare the aqueous liquid is not critical and can be at the usual source temperature.

Processes

We have found that dry laying of fibers into a web does not reliably achieve the requisite degree of uniformity of fiber distribution. Therefore, in a process according to the present invention, the fibers are wet-laid by any of several wet-laying methods.

Reference is now made to FIG. 1 which diagrams a representative process 10 according to the present invention. As indicated in FIG. 1, the process 10 involves serial passage through three zones: a pulping zone 12, a wet-laying zone 14, and a drying zone 16.

In the pulping zone 12, in preparation for wet-laying the fibers, the fibers 18 of the first material and the fibers 20 of the second material are added to an aqueous liquid comprising water 22, one or more surfactants 24 (if required), and optionally a viscosity modifier 26 and a defoamer 28 to form a mixture.

In the pulping zone 12, the mixture of the aqueous liquid and fibers are formed into a suspension of fibers by agitation. Agitation is continued until the fibers are uniformly distributed in the suspension.

Agitation of the suspension is preferably vigorous, which creates a large number of tiny air bubbles within the suspension. The air bubbles facilitate physical separation of individual fibers from one another. As the fibers separate, they become thoroughly wetted (a solution process that is aided by the surfactant present in the liquid) so as to ensure that the fibers do not re-adhere to each other before being wet-laid. It is preferred that the agitation not be so violent as to cause fiber breaking or excessive foaming.

After suspending but before wet-laying the fibers, the suspension of fibers is preferably subjected to an aqueous dilution step that serves to lower the concentration of fibers in the suspension about ten-fold. Thus, after dilution, the concentration of fibers in the suspension is about 0.01 to about 1.0% (w/w). The dilution step is preferably performed just before passing the suspension into the wet-laying zone 14 but after the fibers have been thoroughly wetted and uniformly suspended in the pulping zone 12. Preferably, the suspension is diluted by adding "white water" 32 described below, which reduces the overall water consumption of the process. Fresh water can also be used as a diluent, if necessary, either alone or as a supplement to the white water. Fibers are kept uniformly suspended after dilution up until the moment of wet-laying the fibers.

In the wet-laying zone 14, the fibers are wet-laid to form a wet, non-woven, sheetlike web having a uniform distribution of fibers. Preferably, wet-laying the fibers is performed as a continuous process which yields a longitudinally extended web. Most of the aqueous liquid in which the fibers are suspended is removed as the fibers are wet-laid. The removed aqueous liquid, termed "white water" 32, contains water, fiber fines and chemicals (surfactants and other additives). In the interest of economy and pollution control, white water can be recycled and added to the fiber suspension in the upstream dilution step described above.

The fibers are wet-laid using any of various appropriate devices known in the art for forming wet, non-woven webs. Suitable wet-laying equipment is discussed in greater detail below.

After the wet-laying step, the wet, non-woven web is fragile and easily fractured or torn. In fact, the wet web is incapable of supporting its own weight (particularly at low basis weights) and must be supported during passage through downstream processing steps. This is because chopped wetted fibers of synthetic polymeric materials in the absence of chemical binders typically do not have adequate surface roughness or other inherent quality permitting interfiber interaction of sufficient strength to hold the wet web together. A preferred way of supporting the web is with a continuous sheetlike belt or "felt," discussed in greater detail below.

If desired, additional moisture can be removed from the web by supporting the wet web, immediately after wet-laying, with a "wicking felt" (not shown) as known in the art. Thus, the wicking felt can be used to transport the wet web from the wet-laying zone 14 to the drying zone 16.

Substantially all the remaining free water must be removed from the wet web in the drying zone 16. Such water removal permits the web to be heated in the drying zone 16 to a temperature suitable for causing the binder fibers (fibers of the second thermoplastic material) to bond both to themselves and to the bonded fibers (fibers of the first polymeric material). Both drying and bonding are preferably performed in the drying zone 16.

Thus, the drying zone 16 preferably performs the following functions: (a) supporting the web during drying and bonding; (b) removing the remaining free water from the web; and (c) controllably applying heat (and sufficient mild pressure, if required) to the web to cause the binding fibers to soften sufficiently to adhere the fibers of the web together at points of inter-fiber and intra-fiber contact.

In the drying zone 16, it is important that the temperature at which fiber bonding occurs (and the time during which the web is exposed to said temperature), be carefully controlled. We have found that this temperature should be controlled to within 5° F. of the melt temperature of the binder fibers. Too high a temperature transforms the bonded fibers into molten blobs which destroys their fibrous characteristic and can substantially lessen the strength of the finished web. Too low a temperature causes insufficient adhesion of fibers, which results in a weak finished web. Therefore, for a particular combination of fibers, the optimal bonding temperature (and time at said temperature) will be the particular combination of these variables that yields a finished web with a maximal achievable tensile strength or burst strength for a particular basis weight. Of course, to achieve uniform strength throughout the web, it is important that all portions of the web be exposed to the same drying temperature (and mild pressure) if required, for the same length of time. As can be surmised, such a combination is readily achievable by an automated continuous process.

After drying, the finished web can be rolled up in a conventional manner for storage. A finished web has an unlimited shelf life if stored under non-degradative conditions.

The Apparatus

Figure 2:
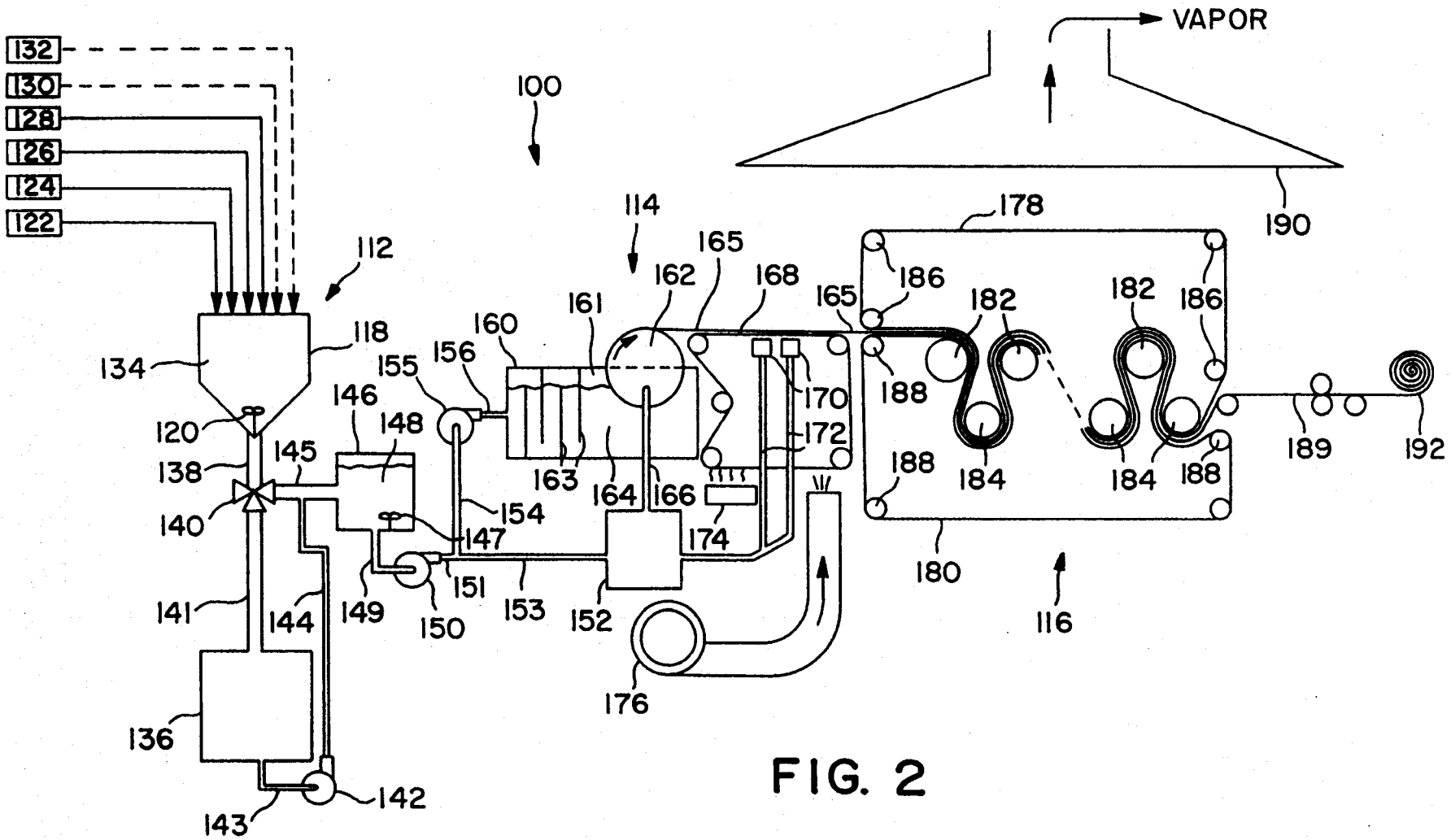
FIG. 2 is a schematic elevational view of an apparatus according to the present invention adapted for making the fabric of the present invention.

A representative apparatus 100 capable of forming a non-woven web according to the present invention is shown in FIG. 2. In accordance with the processes described above, the apparatus 100 comprises essentially three zones: a pulping zone 112, a wet-laying zone 114, and a drying zone 116.

The pulping zone 112 comprises a pulping vessel 118, and an agitator 120. The pulping vessel 118 can be any appropriate shape but is typically cylindrical with a conical bottom and open top. The pulping vessel 118 is adapted to receive water 122, fibers 124 of the first synthetic polymeric material, fibers 126 of the second synthetic polymeric material, a surfactant 128, and optimally a viscosity modifier 130 and a defoamer 132 (if required). These ingredients together are formed into a concentrated aqueous suspension 134 of the fibers.

The agitator 120 can be any of various stirring or vortex mixing devices. For example, the vessel 118 and agitator 120 can together constitute what is known in the art as a cylindrical agitator or "hydro-pulper." In particular, we have had success using a hydro-pulper that includes, for agitation, a motor driven, serrated disk located at the bottom of the vessel 118 that rotates at about 1,500 revolutions per minute (rpm).

With respect to rotary agitators, the angular velocity of the agitator is not critical. However, for optimal performance, the angular velocity should be high enough to create a strong, deep vortex in the suspension 134 that continuously draws the fibers down into the suspension 134.

If desired, the concentrated aqueous suspension 134 can be drained from the pulping vessel 118 into a stock chest 136 for storage. For example, as shown in FIG. 2, the suspension 134 is drained through a conduit 138, a three-way valve 140, and a conduit 141. At time of consumption, any suspension contained in the stock chest 136 can be delivered from the stock chest using a pump 142 and appropriate conduits 143, 144.

In accordance with processes according to the present invention described above, the concentrated aqueous suspension 134 of fibers is diluted before entering the wet-laying zone 114. Of course, it would be possible to eliminate the need to dilute the suspension 134 by simply adding sufficient water to a suitably large pulping vessel 118 to achieve a fiber concentration of about 0.05 to about 0.1% (w/w). However, under normal industrial conditions, such a vessel would typically be impracticably large. Thus, preparing a concentrated suspension 134 and diluting it before wet-laying provides a more space-saving and cost-effective way of achieving the same result.

Referring further to FIG. 2, the concentrated aqueous suspension 134 can be delivered from the pulping vessel 118 through the conduit 138, the valve 140, and a conduit 145 to a machine chest 146. Alternatively, concentrated aqueous suspension can be delivered from the stock chest 136 through the conduit 143, the pump 142, the conduit 144, and the conduit 145 to the machine chest 146. In either instance, a constant liquid level is preferably maintained in the machine chest 146.

In FIG. 2, the machine chest 146 is provided with an agitator 147 to sufficiently agitate the concentrated aqueous suspension 148 in the machine chest 146 so as to maintain uniformity of fiber concentration in the suspension.

The concentrated aqueous suspension 148 is delivered from the machine chest 146 through a conduit 149, a pump 150, and a conduit 151, and diluted with "white water" delivered from a white water chest 152 through a conduit 153. The diluted aqueous suspension then passes through a conduit 154, a pump 155, and a conduit 156 to the wet-laying zone 114. The wet-laying zone 114 comprises a headbox 160 with a forming region 161, and a "former" 162 partially immersed in the forming region 161 of the headbox 160.

The former 162 is preferably a Rotoformer® (Sandy Hill Corp., Hudson Falls, N.Y.) rotary cylindrical former as known in the art employing vacuum dewatering. However, any of various other formers employing a rotating cylinder mold and, preferably, vacuum dewatering, can also be employed. Representative alternative rotary formers, not intended to be limiting, include Deltaformers® and Sigmaformers® (Sandy Hill Corp., Hudson Falls, N.Y.). Instead of a cylindrical former, a forming wire as used in fourdrinier machines can also be used.

The headbox 160 is adapted to maintain a constant hydraulic level relative to the former 162. The headbox 160 is also adapted to maintain a uniform distribution of fibers in the dilute suspension of fibers before the suspension contacts the former. For these purposes, the headbox 160 comprises vertically staggered baffles 163 extending laterally thereacross which provide a convoluted pathway to the forming region 161.

A rotary former 162 typically comprises a transversely oriented forming cylinder covered on its cylindrical surface with a woven wire cloth or other rigid porous material that freely passes liquids therethrough but inhibits passage therethrough of the fibers in the dilute suspension. The former 162 is partially immersed in the dilute suspension 164 in the forming region 161 of the headbox 160. As the former 162 revolves about its axis at a constant angular velocity, a wet non-woven web 165 of fibers forms on the cylindrical surface of the former 162 as the aqueous liquid drains from the forming region 161 through the porous surface into the interior of the former 162. Thus, the rotating former 162 effectively both forms the wet non-woven web 165 and draws the web out of the forming region 161. The web is produced continuously and is therefore longitudinally extended.

As the wet non-woven web 165 forms on the former 162, gravity urges drainage of the aqueous liquid in the dilute suspension 164 to flow into the interior of the former 162. To facilitate such flow, the pressure inside the former 162 can be lowered to sub-atmospheric. The resulting "suction" also facilitates more rapid formation of the wet non-woven web 165 and more rapid removal of excess water from the web before the web leaves the former 162. Since the aqueous liquid drawn through the former contains a small amount of fibrous material, it has a "diluted milk" color and is therefore termed "white water." The white water can be discharged to a drain or deposited in the white water chest 152 for recycling. As shown in FIG. 2, recycled white water is drained from the former 162 through a conduit 166 to the white water chest 154. The white water is then used to dilute the suspension of fibers as discussed above.

At the moment the wet non-woven web 165 leaves the surface of the former 162, the web still contains an amount of water sufficient to provide the web with sufficient structural integrity to be lifted off the former 162. However, as discussed above, the wet non-woven web 165 is too fragile to support its own weight over any significant span. We have found that removing more water from the web without also causing interfiber bonding can result in even further reductions in web strength, in contrast to webs made from natural fibers such as cellulose. The reason for such behavior with webs according to the present invention is not entirely understood. In any event, it is important according to the present invention that the apparatus 100 be adapted to provide physical support to the web until bonding is complete.

During passage of the wet non-woven web 165 from the former 162 to the drying zone 116, a preferred way to provide physical support is to place the web 165 on a continuous "wicking" felt 168 as known in the art to facilitate further liquid removal from the web. As shown in FIG. 2, the wicking felt 168 lifts the wet non-woven web 165 off the former 162 at about the highest point on the circumference of the former. As known in the art, liquid passing from the web 165 into the wicking felt 168 can be removed from the felt by passing the felt over transversely extended vacuum boxes 170. Any such liquid can be recycled via conduits 172 to the white water chest 152. In addition, excess liquid can be removed by exposing the wicking felt 168 to a radiant heat source 174 or to air discharged from a blower 176.

Referring further to FIG. 2, the drying zone 116 preferably comprises a dual-felt drying apparatus including an upper dryer felt 178, a lower dryer felt 180, and an array of plural heated upper dryer "cans" 182 and heated lower hot dryer "cans" 184. As known in the art, a dryer "can" is a heated cylindrical drum rotated at a constant angular velocity about a horizontal axis oriented transversely to the longitudinal dimension of the web. When employing a multiplicity of such dryer cans, we have found that sandwiching the web between the upper felt 178 and the lower felt 180 provides adequate mechanical support for the web 164 as it passes through the drying zone 116. Even drying through the thickness dimension of the web is achieved by alternately passing the web, while sandwiched between the drying felts, around an upper can 182 then a lower can 184 (or vice versa). Multiple upper and lower cans (usually the same number of each) are typically required, as shown in FIG. 2, to achieve thorough drying and proper fiber bonding.

The "twin felts" 178, 180 actually contact the cylindrical surfaces of the dryer cans 182, 184 while maintaining structural integrity of the web as water is removed from the web and fiber bonding takes place. Thus, the web does not actually touch the surfaces of the dryer cans.

According to a preferred embodiment, each dryer felt has a knitted construction and is made from a heatresistant polymeric material that allows for passage therethrough of heat and moisture. The continuous upper felt 178 is supported by rollers 186 in a convoluted path so as to begin supporting the web as the web enters the drying zone 116 and part from the web as the web exits the drying zone 116. The lower felt 180 is similarly supported by rollers 188 in a convoluted path. In this way, the upper felt 178 directly contacts the lower dryer cans 184, and the lower felt 180 directly contacts the upper cans 182.

The upper and lower felts 178, 180, respectively, also serve to urge passage of the web through the drying zone 116. The dryer felts 178, 180 are conveyed through the drying zone 116 at a substantially identical velocity. Thus, the web moves through the drying zone 116 at a longitudinal velocity which, in an automated process according to the present invention, is coordinated with the rate at which the web 165 is produced in the wet-laying zone 114.

An important benefit of using the dual-felt drying apparatus, as described above, is that the two dryer felts 178, 180 protect the web 165 from directly contacting the hot dryer cans 182, 184. Direct contact of the web with the dryer cans could cause either delamination or breakage of the web as the web passes through the drying zone 116. It is, therefore, important that the dryer felts 178, 180 be made from a material that can withstand the surface temperature of the dryer cans. In other words, the dryer felts 178, 180 are preferably made of a material having a melt temperature substantially higher than the surface temperature of the dryer cans.

The dryer cans 182, 184 are hollow and conventionally made of cast steel. In one embodiment the cans are each about 7 feet long with a diameter of about 3 feet. However, the cans can have other dimensions as appropriate, depending upon the required production volume and type of non-woven fabric made. The cans are typically heated by steam to achieve a surface temperature of about 200° F. to about 400° F., depending on the melt temperature of the binder fibers in the web. For example, a representative surface temperature for drying and bonding a polyester-based web is between about 350° F. and 400° F. The particular temperature, of course, depends upon the melt temperature of the binder fibers. The temperature of the dryer cans is tightly controlled, usually within ±5° F., to ensure optimal and uniform bonding. Additionally, tension of the dryer felt may influence the drying of the web.

Heat imparted to the web by the dryer cans not only dries the web but also causes a transient softening of the binder fibers when the web reaches a melt temperature of the binder fibers. This heat, along with a mild compression applied by the dryer felts to the web sandwiched therebetween, causes the binder fibers to bond to each other and to the bonded fibers at points of interfiber contact. In this way, the web is first substantially dried by passage through the drying zone, then bonded to produce the fabric 189.

Vapor generated by the wet non-woven web 165 being routed through the drying zone 116 is collected and discharged from the drying zone using an appropriate venting device 190.

After passing through the drying zone 116, the finished non-woven fabric 189 can be formed into a roll 192 for storage.

Fabrics

Non-woven fabrics according to the present invention have excellent uniformity of fiber distribution, excellent mechanical integrity, and superior tensile and bursting strength, particularly at low basis weights. The fabrics comprise about 10% to about 65% of the bonded fibers and about 90% to about 35% of the binder fibers.

The preferred basis weight of fabrics according to the present invention is about 0.5 ounce per square yard (17 g/m$^2$). However, the basis weight can be within a range of about 0.25 to about 2 ounces per square yard.

The thickness of the finished fabric is somewhat less than the thickness of the wet, non-woven web before drying.

The burst strength of the fabric is about 5 to about 30 pounds per square inch, depending on the type of fibers comprising the fabric and the drying temperature used. Typically, with polyester fabrics, the burst strength is about 11 to about 20 pounds per square inch.

The tensile strength can be about 4 to about 8 pounds per inch of width at a fabric basis weight of about 0.5 ounces per square yard.

Fabrics according to the present invention are useful in any of the following general applications: apparel, home furnishings, agriculture, medical, engineering, and building construction. Fabrics according to the present invention are particularly suited for such uses because of their excellent mechanical strength, drapeability, and uniformity of fiber distribution, all at lower basis weights than prior-art non-woven fabrics.

EXAMPLE 1

A polyester fabric according to the present invention was produced having a fiber profile as shown in Table 1. This fabric had excellent hand and a substantially uniform distribution of fibers.

TABLE 1

| Fiber Type | Material | Denier | Length | Amount |
|---|---|---|---|---|
| Bonded | Polyester | 1 | 0.5" | 40% w/w |
| Binder | Polyester | 1 | 0.5" | 60% w/w |

Specifically, the type of polyester comprising the bonded fibers was a Trevira® polyester; and the type of polyester comprising the binder fibers was Celbond® polyester. The melt temperature of the bonded fibers was 475°–480° F. and the melt temperature of the binder fibers was 392° F.

EXAMPLE 2

A polyester fabric according to the present invention was produced having a basis weight of about 0.5 ounce per square yard. Certain physical properties of the fabric were determined, as shown in Table 2.

This fabric was then compared to prior-art spunbonded and prior-art dry-laid fabrics having the same basis weight, as shown in Table 3.

TABLE 2

| Property | Value |
|---|---|
| Basis Weight (oz/yd$^2$) | 0.5 |
| Weight Coefficient of Variation (%) | 7–11 |
| Thickness (mil) | 2.5–3.0 |
| Air Permeability (CFM/ft$^2$) | 1200–1500 |
| Burst Strength (psi) | 5–30 |
| Tensile Strength (pounds/inch) | |
| Machine Direction | 6–10 |
| Cross Direction | 1–5 |

TABLE 2-continued

| Property | Value |
|---|---|
| Elongation (%) | |
| Machine Direction | 12–16 |
| Cross Direction | 13–17 |
| Tear Strength (lb) | |
| Machine Direction | 0.8–1.0 |
| Cross Direction | 0.6–0.8 |
| Bending (mm) | 24–31 |

TABLE 3

| Property | Fabric of Present Invention | Prior Art Spunbonded Fabric | Prior Art Dry-Laid Fabric |
|---|---|---|---|
| Air Permeability ($CFM/ft^2$) | 1363 | 2394 | 1797 |
| Coefficient of Variation (%) | 26.8 | 39.5 | 23.2 |
| Burst Strength (psi) | 15.0 | 9.9 | 3.4 |
| Tensile Strength (pounds/inch) | | | |
| Machine Direction | 7.9 | 3.2 | 2.9 |
| Cross Direction | 3.2 | 2.8 | 0.4 |

The air permeability of the fabrics was tested according to ASTM #D737.

The prior-art fabrics and the fabric of the present invention were tested according to ASTM #D3786 for burst strength and ASTM #D1682 for tensile strength.

The results of Table 3 show that wet-laid fabrics according to the present invention exhibit higher burst and tensile strengths compared to prior art spunbonded and dry-laid fabrics of the same basis weight. In addition, the air permeability of a fabric according to the present invention is consistent with the greater uniformity of fiber distribution throughout the fabric.

EXAMPLE 3

This example illustrates that wet-laid fabrics according to the present invention exhibit a small reduction in burst strength whenever the basis weight of the fabric is decreased by about half. Results are shown in Table 4.

TABLE 4

| Type of Fabric | Burst Strength (psi) | Tensile Strength (MD**) (lb/in) | Reduction Burst Strength | Factor* Tensile Strength |
|---|---|---|---|---|
| Wet-laid (Present Invention) | | | | |
| 1.0 $oz/yd^2$ | 19.3 | 6.8 | 1.29 | 0.86 |
| 0.5 $oz/yd^2$ | 15.0 | 7.9 | | |
| Spunbonded (Prior Art) | | | | |
| 1.0 $oz/yd^2$ | 21.7 | 10.3 | 2.19 | 3.22 |
| 0.5 $oz/yd^2$ | 9.9 | 3.2 | | |
| Dry-laid (Prior Art) | | | | |
| 1.0 $oz/yd^2$ | 20.8 | 14.4 | 6.12 | 4.97 |
| 0.5 $oz/yd^2$ | 3.4 | 2.9 | | |

*Reduction factor is determined by dividing the 1.0 $oz/yd^2$ value by the 0.5 $oz/yd^2$ value
**MD-machine direction For comparison, dry-laid and spunbonded prior-art fabric samples were similarly tested. As shown in Table 4, prior-art spunbonded fabric underwent a burst-strength reduction from 21.7 to 9.9 $oz/yd^2$ (a reduction factor of 2.19) when the basis weight was reduced from 1.0 $oz/yd^2$ to 0.5 $oz/yd^2$. A prior-art dry-laid fabric showed a burst-strength reduction from 20.8 to 3.4 (a reduction factor of 6.12) when the basis weight was similarly halved. A polyester fabric according to the present invention, in contrast, only experienced a burst-strength reduction from 19.3 to 15.0 (a reduction factor of 1.29) when the basis weight was halved from 1.0 $oz/yd^2$ to 0.5 $oz/yd^2$.

The tensile strengths of the prior art spunbonded and dry-laid fabrics were reduced by a factor greater than 2 when the basis weight was reduced from 1.0 $oz/yd^2$ to 0.5 $oz/yd^2$. In contrast, the fabric according to the present invention exhibited a reduction factor for tensile strength of less than 1.

Having illustrated and described preferred embodiments of fabrics, as well as apparatus and methods for making the same, it should be apparent to those skilled in the art that the illustrated embodiment and method for making the same may be modified in arrangement and detail. We claim as our invention, not only the illustrated embodiments and methods, but all such modifications, variations and equivalents thereof as come within the true spirit and scope of the following claims.

We claim:

1. A wet laid non-woven polyester fabric consisting essentially of:
   (a) about 10 to about 65% staple bonded fibers consisting essentially of polyester, the bonded fibers each having a length up to about 1 inch;
   (b) about 35 to about 90 staple binder fibers consisting essentially of polyester, the binder fibers each having a length up to about 1 inch, the binder and bonded fibers being formed into a non-woven web in which the binder and bonded fibers are substantially uniformly distributed and in which the binder fibers are thermally bonded to the bonded fibers at points of inter-fiber contact; and
   (c) the non-woven web having a basis weight of about 0.25 to about 2 ounces per square yard.

2. The fabric of claim 1 exhibiting a reduction of burst strength of a factor of less than about 1.5 whenever the basis weight of the fabric is reduced by a factor of about 2.

3. The fabric of claim 1 having a basis weight of about 0.25 to about 1 ounce per square yard and a burst strength of about 5 to about 30 $pounds/inch^2$.

4. The fabric of claim 1 having a basis weight of about 0.5 ounce per square yard.

5. The fabric of claim 1 having a burst strength of about 11 to about 20 pounds per square inch and a basis weight of about 0.5 ounce per square yard.

6. The fabric of claim 5 having a burst strength of about 15 pounds per square inch and a basis weight of about 0.5 ounce per square yard.

7. The fabric of claim 1 wherein the bonded fibers have a thermoplastic property.

8. A wet laid non-woven polyester fabric consisting essentially of:
   (a) about 10 to about 65% staple bonded fibers consisting essentially of polyester including a first polyester material, the bonded fibers having a denier of about 0.25 to about 1.5 and a length up to about 1 inch;
   (b) about 35 to about 90% staple binder fibers consisting essentially of polyester including a second polyester material having thermoplastic properties, the binder fibers having a denier of about 0.25 to about 3.0 and a length up to about 1 inch, the binder fibers and the bonded fibers being substantially uniformly distributed in the fabric wherein the binder fibers are thermally bonded to the bonded fibers and to the binder fibers so as to form a non-woven web of said fibers.

9. A non-woven fabric as recited in claim 8 having a basis weight of about 0.25 to about 2 ounces per square yard and a burst strength of about 5 to about 30 pounds per square inch.

10. A non-woven fabric as recited in claim 9 exhibiting a reduction of burst strength of a factor of less than about 1.5 whenever the basis weight of the fabric is reduced by a factor of about 2.

11. A non-woven fabric as recited in claim 10 having a burst strength of about 11 to about 20 pounds per square inch and a basis weight of about 0.5 ounce per square yard.

12. A non-woven fabric as recited in claim 8 having a burst strength of about 15 pounds per square inch.

13. A non-woven fabric as recited in claim 8 wherein the first polyester material is a thermoplastic material.

14. A non-woven fabric as recited in claim 8 wherein the bonded and binder fibers have a denier of about 1.5 to 3.0 denier.

15. A wet laid polyester fabric consisting essentially of:

(a) about 10 to about 65% staple bonded fibers consisting essentially of polyester including a first polyester material, the bonded fibers having a first melt temperature and a length up to about 1 inch; and (b) about 35 to about 90% staple binder fibers consisting essentially of polyester including a second material, the binder fibers having a second melt temperature lower than the first melt temperature by at least about 25° F., the bonded and binder fibers being substantially uniformly distributed in the fabric as a result of being wet-laid, in which fabric the binder fibers are thermally bonded to other binder fibers and to bonded fibers in the form of a non-woven web of said bonded and binder fibers, the web having a tensile strength in the machine direction of about 4 to about 8 pounds per inch of width at a basis weight of about 0.5 ounce per square yard.

16. A non-woven fabric as recited in claim 15 wherein the second polyester material has a melt temperature of about 180° F. to about 400° F.

17. A non-woven fabric as recited in claim 16 wherein the first polyester material has a melt temperature greater than 400° F.

* * * * *

UNITED STATES PATENT AND TRADEMARK OFFICE

CERTIFICATE OF CORRECTION

PATENT NO. : 5,415,738

DATED : May 16, 1995

INVENTOR(S) : MEHTA ET AL.

It is certified that error appears in the above-identified patent and that said Letters Patent is hereby corrected as shown below:

Column 14, line 28, "90" should be --90%--.

Signed and Sealed this

Seventeenth Day of October, 1995

*Attest:*

Bruce Lehman

BRUCE LEHMAN

*Attesting Officer*

*Commissioner of Patents and Trademarks*